US005447474A

United States Patent [19]

Chang

[11] Patent Number: 5,447,474

[45] Date of Patent: Sep. 5, 1995

[54] GAME APPARATUS WITH MULTIPLE PLAYING MODES

[76] Inventor: Fountain Chang, 2800 Leavenworth St., Suite 43, San Francisco, Calif. 94133

[21] Appl. No.: 273,895

[22] Filed: Jul. 12, 1994

[51] Int. Cl.[6] ..... A63G 1/32

[52] U.S. Cl. ..... 472/113; 472/106

[58] Field of Search ..... 472/106, 108, 110, 112, 472/113

[56] References Cited

U.S. PATENT DOCUMENTS

| | | | |
|---|---|---|---|
| 4,896,877 | 1/1990 | Moomaw et al. | 472/106 X |
| 5,217,411 | 6/1993 | Speetor et al. | 472/106 |

FOREIGN PATENT DOCUMENTS

| | | | |
|---|---|---|---|
| 457105 | 9/1929 | Germany | 472/106 |
| 3520376 | 5/1986 | Germany | 472/106 |
| 3533223 | 3/1987 | Germany | 472/106 |

*Primary Examiner*—Carl O. Friedman
*Assistant Examiner*—Beth A. Aubrey
*Attorney, Agent, or Firm*—Ladas & Parry

[57] ABSTRACT

A game apparatus with multiple playing modes includes a base unit, a plank support mounted uprightly on the base unit, and an elongated plank unit. The plank support includes a pair of parallel upright plates, a balancing seat which extends between top ends of the upright plates and which has two ends mounted rotatably on the upright plates, a cylindrical support rod which extends between the upright plates below the balancing seat and which has two ends mounted rotatably on the upright plates, and a positioning beam which extends between the upright plates and which is spaced vertically from the support rod so as to form a clearance therewith. The plank unit is mounted to the plank support selectively in a first position, wherein the plank unit has an intermediate portion which is mounted removably on the balancing seat to permit reciprocating pivoting movement of the plank unit, and a second position, wherein the plank unit extends movably and removably through the clearance such that the plank unit is supported by the support rod to permit alternating forward and rearward sliding movement of the plank unit relative to the plank support.

13 Claims, 8 Drawing Sheets

GAME APPARATUS WITH MULTIPLE PLAYING MODES

BACKGROUND OF THE INVENTION

1. Field of the Invention

The invention relates to a game, more particularly to a game apparatus with multiple playing modes.

2. Description of the Related Art

Presently, the games found in most playgrounds, such as seesaws and swings, remain popular with children even though electronic amusement games have already invaded our households. In this industrial age, the space allocated for playgrounds is getting smaller due to the overcrowded conditions in most places. Thus, it is very unlikely that new playgrounds would be installed with the games found in most playgrounds of the old days due to lack of space.

SUMMARY OF THE INVENTION

The main objective of the present invention is to provide a game apparatus with multiple playing modes, which game apparatus is relatively simple in construction and requires a relatively small space when in use.

Accordingly, the game apparatus of the present invention comprises a base unit, a plank support mounted uprightly on the base unit, and an elongated plank unit.

The plank support includes a pair of parallel upright plates, a balancing seat which extends between top ends of the upright plates and which has two ends mounted rotatably on the upright plates, a cylindrical support rod which extends between the upright plates below the balancing seat and which has two ends mounted rotatably on the upright plates, and a positioning beam which extends between the upright plates and which is spaced vertically from the support rod so as to form a clearance therewith.

The plank unit is mounted to the plank support selectively in a first position, wherein the plank unit has an intermediate portion which is mounted removably on the balancing seat to permit reciprocating pivoting movement of the plank unit, and a second position, wherein the plank unit extends movably and removably through the clearance such that the plank unit is supported by the support rod to permit alternating forward and rearward sliding movement of the plank unit relative to the plank support.

The positioning beam is disposed above the support rod. The plank unit has a bottom surface which is provided with a slide rail that extends along a longitudinal length thereof. The balancing seat is formed with a recess along a transverse length thereof to permit extension of the slide rail therethrough when the plank unit is mounted to the plank support in the first position. The support rod is formed with an annular peripheral groove for supporting the slide rail therein when the plank unit is mounted to the plank support in the second position.

The plank unit has two end portions interconnected by the intermediate portion. The intermediate portion has a top surface that is provided with a spaced pair of stop members, each of which being adjacent to a respective one of the end portions and being disposed along the longitudinal length of the plank unit. The positioning beam has two sides provided respectively with a spring unit that is compressible by a corresponding stop member.

A support plate is mounted rotatably on the base unit, and the plank support is secured on the support plate. The base unit and the support plate are formed with alignable fixing holes. A peg is inserted selectively and removably into the fixing holes to lock non-rotatably the support plate on the base unit.

In one embodiment, the plank support comprises an upright first support secured on the support plate and a second support. The first support has opposite sides respectively formed with a plurality of vertically-spaced horizontally-extending ribs. The second support includes the upright plates, the balancing seat, the support rod and the positioning beam. Each of the upright plates has a bottom end and an inner surface formed with a spaced pair of horizontally-extending engaging ribs adjacent to the bottom end thereof. The engaging ribs cooperate to form a horizontally-extending slot on each of the upright plates. Each of the slots engages removably a selected one of the ribs on the first support.

The first support further has a top surface, and the plank unit is further mounted to the plank support selectively in a third position, wherein the second support is removed from the first support and the intermediate portion of the plank unit is mounted removably on the top surface of the first support.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
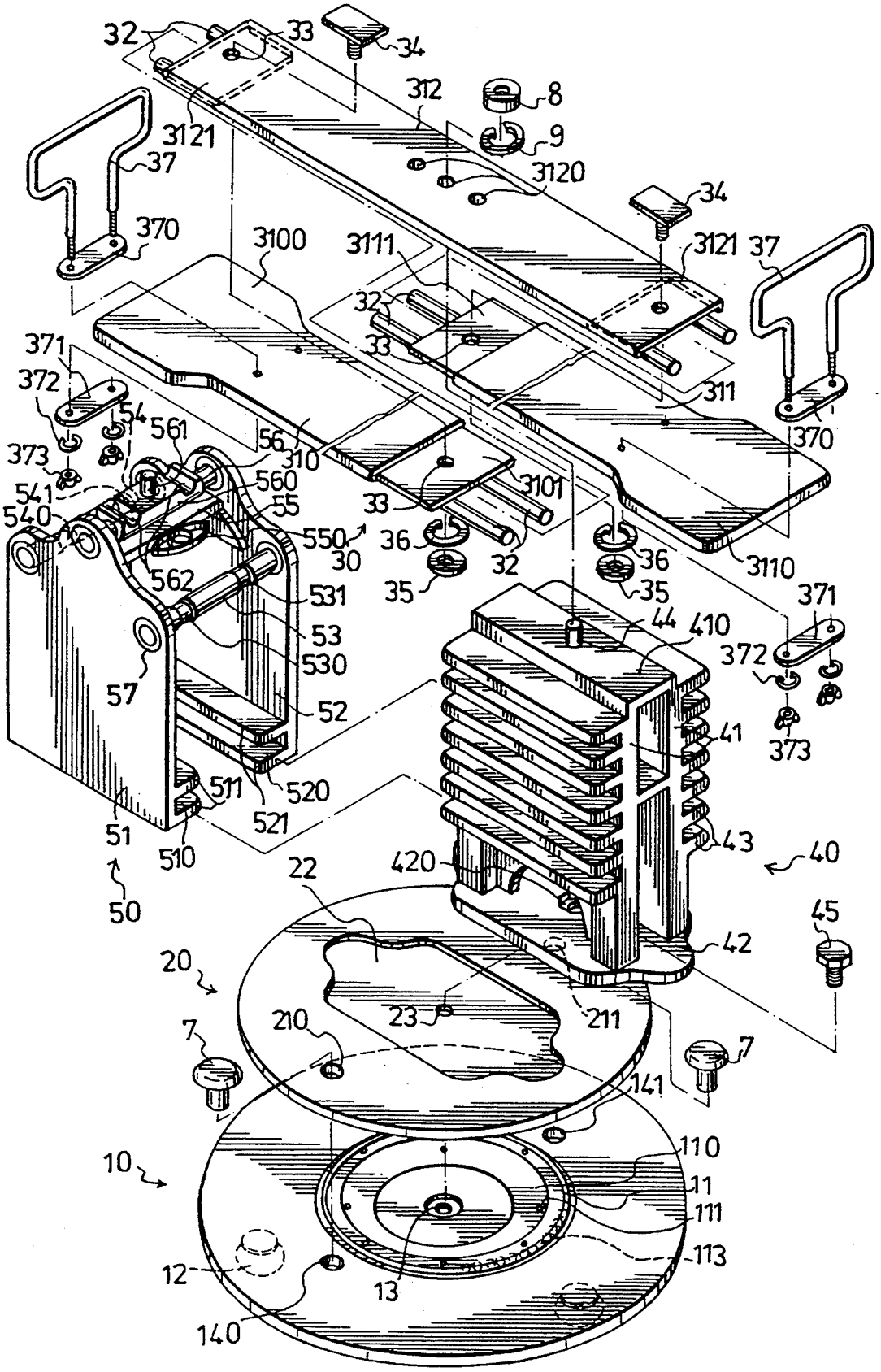
FIG. 1 is an exploded view of the preferred embodiment of a game apparatus according to the present invention.

Referring to FIG. 1, the preferred embodiment of a game apparatus according to the present invention is shown to comprise a base unit 10, a support plate 20, a plank unit 30, and a plank support which includes a first support 40 and a second support 50.

Figure 2:
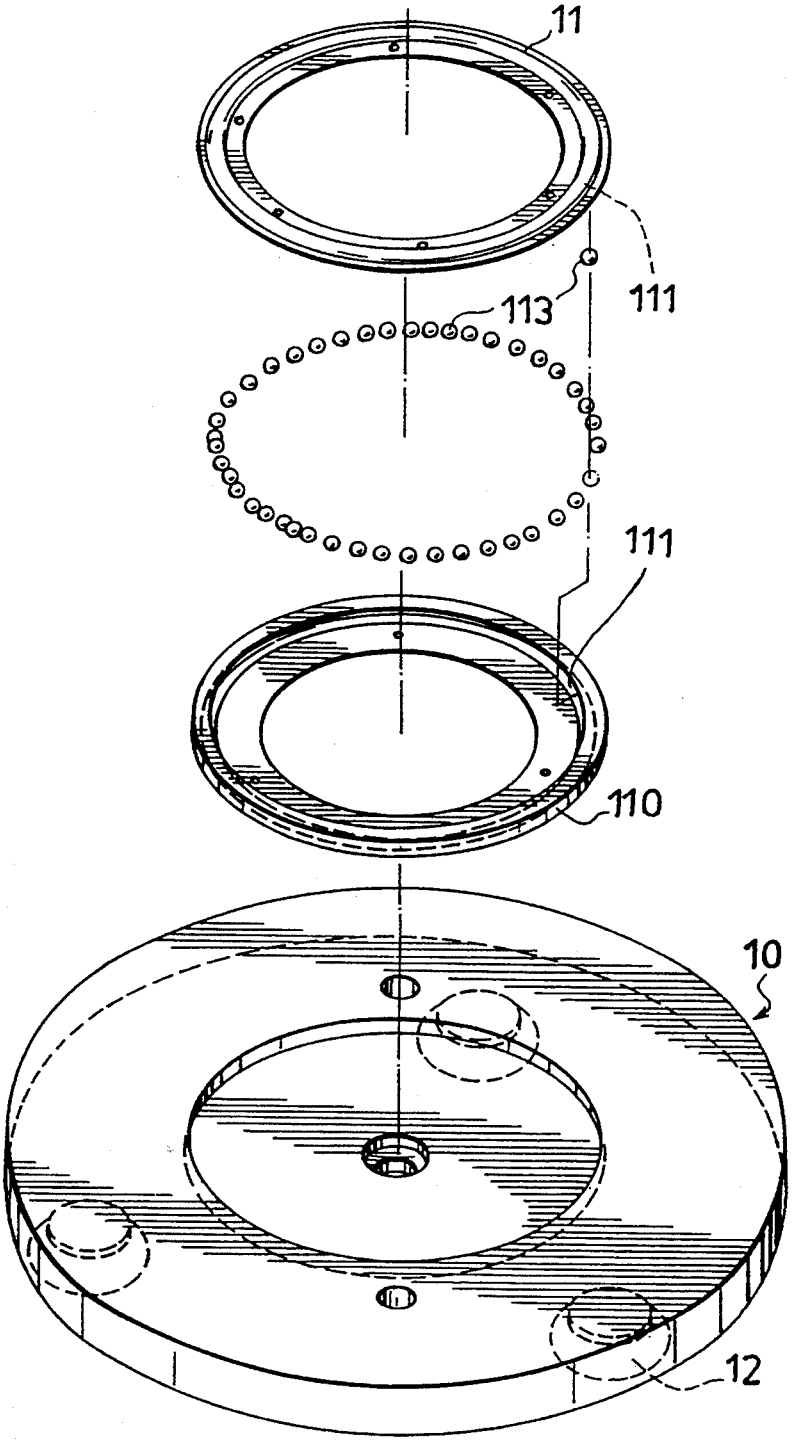
FIG. 2 is an exploded view of a base unit of the preferred embodiment.

The base unit 10 is a circular base which has three angularly spaced foot posts 12 connected to a bottom surface thereof (only two foot posts 12 are shown). The base unit 10 is formed with a central fastener hole 13. Referring to FIGS. 1 and 2, an annular retaining plate 110 is disposed on a top surface of the base unit 10 and is concentric with the latter. An annular rotary plate 11 is disposed on top of the retaining plate 110 and is concentric with the latter. The rotary plate 11 forms a clearance 111 with the retaining plate 110. The retaining plate 110 has a hook-like outer peripheral portion which engages the outer periphery of the rotary plate 11. A plurality of ball bearings 113 are interposed between the retaining plate 110 and the outer peripheral portion of the rotary plate 11 to retain the rotatability of the rotary plate 11 on the base unit 10. The base unit 10 is further formed with a pair of diametrically opposite fixing holes 140, 141 around the rotary plate 11.

The support plate 20 is a circular plate which is disposed on top of the base unit 10. The support plate 20 is supported on the rotary plate 11 and is capable of rotating therewith relative to the base unit 10. The support plate 20 is formed with two diametrically opposite fixing holes 210, 211 which are alignable with the fixing holes 140, 141 of the base unit 10. A pair of pegs 7 can be inserted selectively and removably into the aligned fixing holes 140, 141, 210, 211 of the base unit 10 and the support plate 20 to lock non-rotatably the support plate 20 on the base plate 10. The support plate 20 has a top surface which is formed with an elongated recess 22 at a central portion thereof. The support plate 20 further has a central fastener hole 23 to be aligned with the central fastener hole 13 of the base unit 10.

Figure 3:
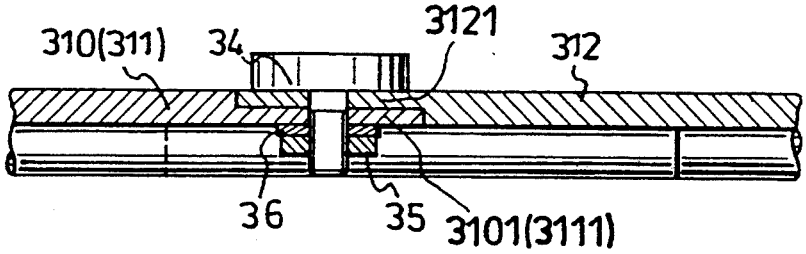
FIG. 3 is a sectional view illustrating a portion of a plank unit of the preferred embodiment.

The plank unit 30 is an elongated member which includes first and second end portions 310, 311 and an intermediate portion 312 which interconnects the first and second end portions 310, 311. The plank unit 30 has a bottom surface which is provided with a spaced pair of longitudinally extending slide rails 32 that extend along a longitudinal length thereof. Each of the first and second end portions 310, 311 has an enlarged first distal section 3100, 3110, and a second distal section 3101, 3111. The intermediate portion 312 further has two distal sections 3121 which cooperate with the second distal section 3101, 3111 of the respective one of the first and second end portions 310, 311 so as to form a straight halved joint. The distal sections 3121 of the intermediate portion 312 and the second distal sections 3101, 3111 are formed with aligned fastener holes 33. The threaded shanks of a pair of stop members 34 extend through the aligned pairs of fastener holes 33. Referring to FIGS. 1 and 3, a locking nut 35 and a spring washer 36 are provided on the threaded shank of each stop member 34 to engage the same, thereby connecting detachably the first and second end portions 310, 311 and the intermediate portion 312.

Figure 4:
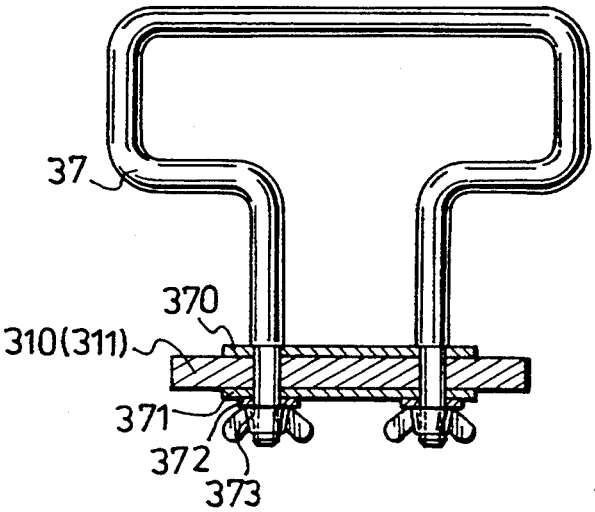
FIG. 4 is a sectional view illustrating how a hand rail is installed on the plank unit of the preferred embodiment.

Referring to FIGS. 1 and 4, each of the first and second end portions 310, 311 is provided with a respective hand rail 37 adjacent to the first distal section 3100, 3110. In this embodiment, each hand rail 37 is formed as a slender rod which is bent so as to have a T-shaped contour. The hand rail 37 has two threaded distal ends which extend through two oblong washer plates 370, 371 that are disposed on top and bottom surfaces of the respective one of the first and second end portions 310, 311. A fly nut 373 and a spring washer 372 are provided on each of the threaded distal ends of the hand rail 37 to engage the same, thereby mounting removably the hand rails 37 on the first and second end portions 310, 311.

Referring again to FIG. 1, the intermediate portion 312 of the plank unit 30 further has a central section which is formed with three spaced mounting holes 3120 that are disposed along the longitudinal length of the plank unit 30. The purpose of the mounting holes 3120 will be detailed in the succeeding paragraphs.

The first support 40 includes a pair of parallel upright plates 41, a top surface 410 which interconnects the top ends of the upright plates 41, and a bottom board 42 which interconnects the bottom ends of the same. The top surface 410 has a central portion which is formed with an upwardly projecting threaded stub 44 for engaging a selected one of the mounting holes 3120 in the intermediate portion 312 of the plank unit 30. The shape of the bottom board 42 conforms with that of the recess 22 formed in the support plate 20. In use, the bottom board 42 of the first support 40 is fitted within the recess 22 in the support plate 20, thereby permitting the first support 40 to stand firmly on the support plate 20 and to rotate with the latter relative to the base unit 10. The bottom board 42 is formed with a central fastener hole 420 to be aligned with the fastener holes 23, 13 of the support plate 20 and the base unit 10. A fastener 45 extends through the aligned fastener holes 420, 23, 13 to secure rotatably the support plate 20 and the first support 40 on the base unit 10. The upright plates 41 have opposite outer surfaces respectively formed with a plurality of vertically-spaced horizontally-extending ribs 43.

The second support 50 includes a pair of parallel upright plates 51, 52. Each of the upright plates 51, 52 has an inner surface which is formed with a spaced pair of horizontally-extending engaging ribs 511, 521 adjacent to the bottom end thereof. The engaging ribs 511, 521 cooperate to form a horizontally-extending slot 510, 520 on each of the upright plates 51, 52. Each of the slots 510, 520 of the upright plates 51, 52 engages removably a selected one of the ribs 43 on the upright plates 41 of the first support 40.

A balancing seat 560 is secured on a mounting rod 56 which extends between top ends of the upright plates 51, 52. The balancing seat 560 extends along the length of the mounting rod 56 and is formed with an upwardly projecting threaded stub 561 for engaging one of the mounting holes 3120 in the intermediate portion 312 of the plank unit 30. The top surface of the balancing seat 560 is further formed with a spaced pair of recesses 562 along a transverse length thereof to permit extension of the slide rails 32 therethrough when the plank unit 30 is mounted on the balancing seat 560.

A pair of cylindrical support rods 53, 54, which are disposed on a generally horizontal plane, extend between the upright plates 51, 52 below the balancing seat 560. Each of the support rods 53, 54 is formed with a spaced pair of annular peripheral grooves 530, 531, 540, 541. A positioning beam 55 extends between the upright plates 51, 52 and is spaced vertically from the support rods 53, 54 so as to form a clearance therewith. The clearance is sufficient to permit the plank unit 30 to pass slidably therethrough. When the plank unit 30 is extended movably through the clearance, the support rods 53, 54 support the slide rails 32 in the peripheral grooves 530, 531, 540, 541 thereof. The positioning beam 55 has two sides respectively provided with a spring unit 550 that is compressible by one of the stop members 34. The purpose of the spring units 550 will be described in greater detail in the succeeding paragraphs. Self-lubricating ball bearings 57 are installed on each end of the support rods 53, 54 and the mounting rod 56 to mount rotatably the same on the upright plates 51, 52.

When mounting the plank unit 30 on the threaded stub 444, 561 of a selected one of the first and second supports 40, 50, the threaded stub 44, 561 is inserted through one of the mounting holes 3120 in the intermediate portion 312 of the plank unit 30. A locking nut 8 and a spring washer 9 engage the threaded stub 44, 561 on top of the plank unit 30, thereby securing the plank unit 30 on the selected one of the first and second supports 40, 50.

Figure 5:
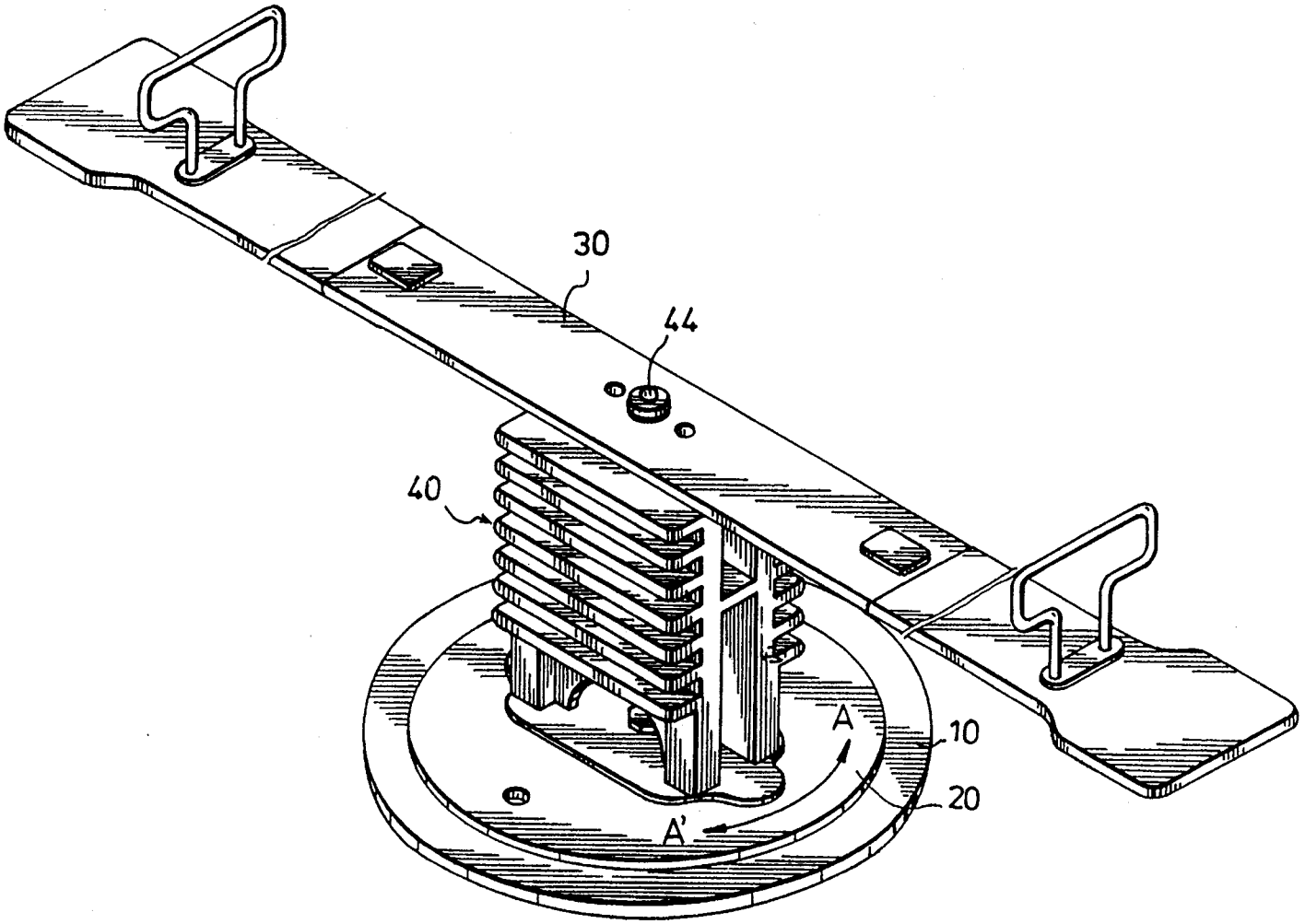
FIG. 5 illustrates a first playing mode of the game apparatus of the present invention.

FIG. 5 illustrates the preferred embodiment when operable in a first playing mode. In this mode, the pegs 7 are removed so as to permit rotation of the support plate 20 relative to the base unit 10, as indicated by the line A–A'. The second support 50 is removed from the first support 40, and the plank unit 30 is mounted directly on the threaded stub 44 of the first support 40 at one of the mounting holes 3120. Two persons are seated on two ends of the plank unit 30, and an external force is applied on the plank unit 30 so as to cause rotation of the first support 40 relative to the base unit 10.

Figure 6:
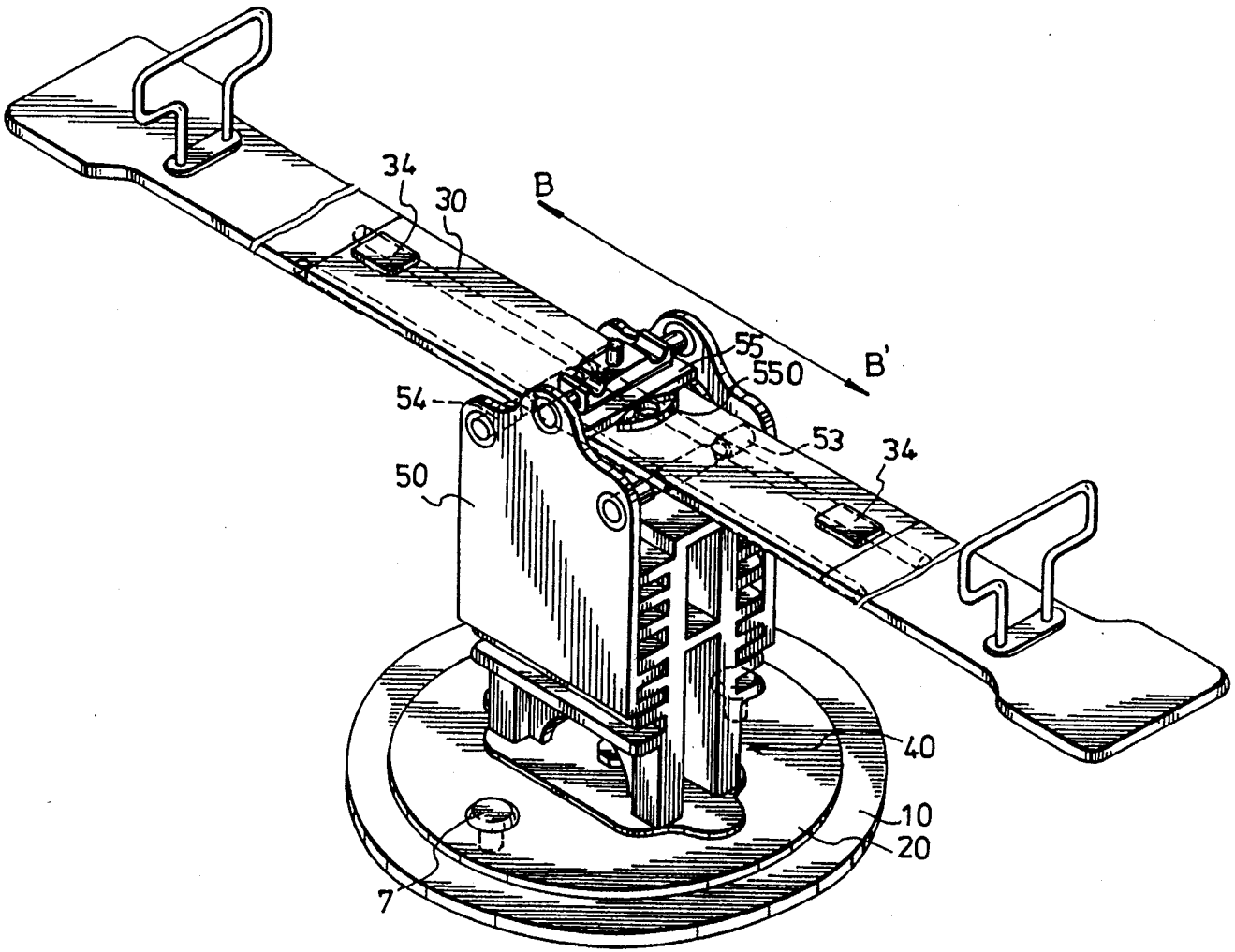
FIG. 6 illustrates a second playing mode of the game apparatus of the present invention.

FIG. 6 illustrates the preferred embodiment when operable in a second playing mode. The pegs 7 are installed to prevent rotation of the support plate 20 relative to the base unit 10. The second support 50 is attached to the first support 40 by inserting two of the ribs 43 on the first support 40 within the slots 510, 520 of the second support 50 in order to dispose the support rods 53, 54 at a desired height relative to the base unit 10. The plank unit 30 is assembled on the second support 50 such that the plank unit 30 passes slidably through the clearance formed between the support rods 53, 54 and the positioning beam 55. At this stage, the slide rails 32 of the plank unit 30 are received slidably in the peripheral grooves 530, 531, 540, 541 of the support rods 53, 54. In use, two persons are seated on two ends of the plank unit 30, and the plank unit 30 is pushed to cause alternating forward and rearward sliding movement of the same, as indicated by the line B–B'. The enlarged heads of the stop members 34 are capable of compressing a corresponding one of the spring units 550 on the positioning beam 55 to limit forward and rearward movement of the plank unit 30 and to enable the spring units 550 to provide a pushing force for moving the plank unit 30 in the opposite direction. The support rods 53, 54 are mounted rotatably on the upright walls 51, 52 to facilitate sliding movement of the slide rails 32.

Figure 7:
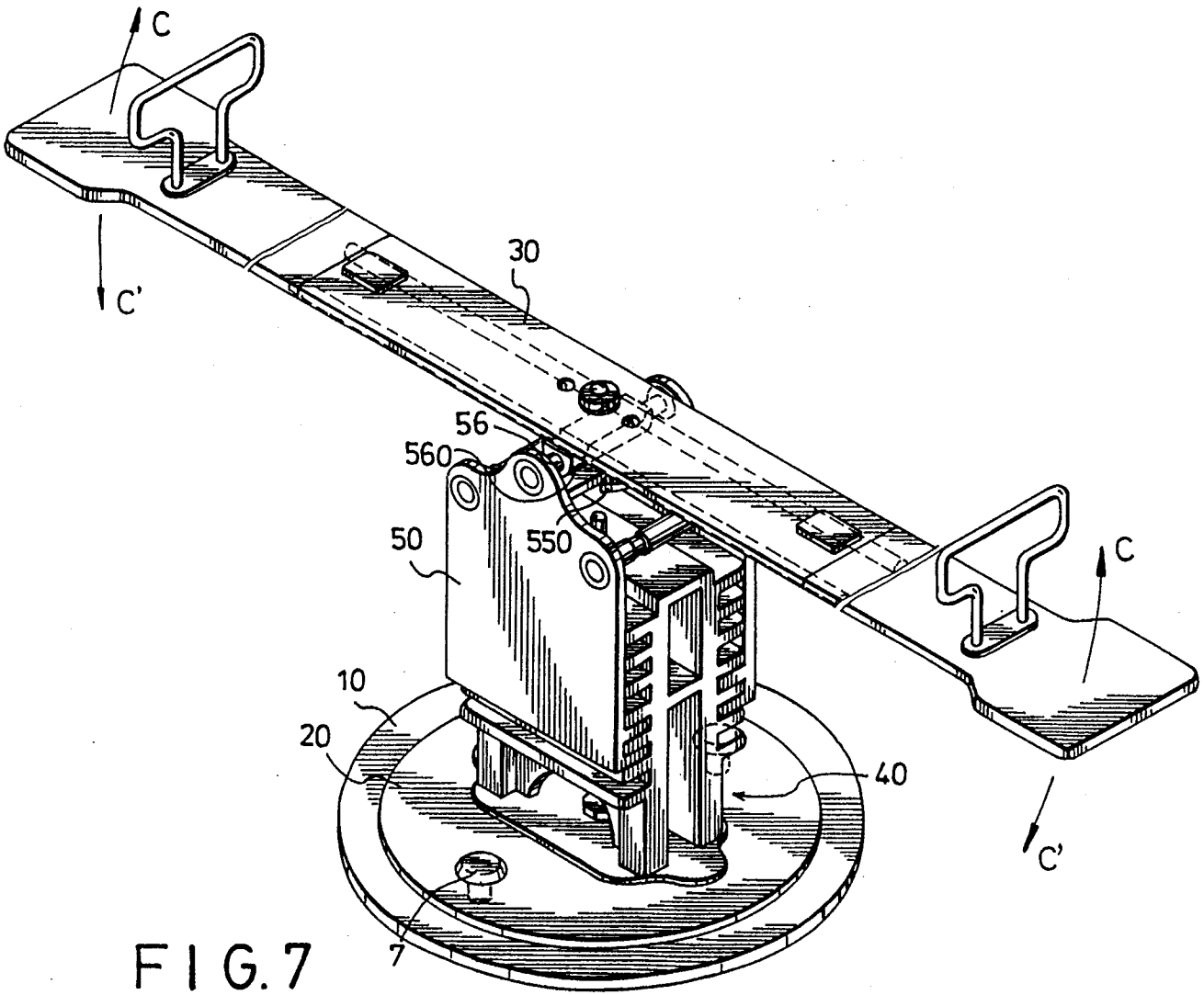
FIG. 7 illustrates a third playing mode of the game apparatus of the present invention.

FIG. 7 illustrates the preferred embodiment when operable in a third playing mode. As with the second playing mode, the pegs 7 are installed to prevent rotation of the support plate 20 relative to the base unit 10. The second support 50 is attached to the first support 40 in the previously described manner so as to dispose the balancing seat 560 at a desired height relative to the base unit 10. The plank unit 30 is mounted directly on the threaded stub 561 of the second support 50 at one of the mounting holes 3120. Two persons are seated on two ends of the plank unit 30, and the plank unit 30 can be made to pivot reciprocatingly in a manner similar to a conventional seesaw, as indicated by the line C–C'. Note that the plank unit 30 is formed with three mounting holes 3120. The plank unit 30 can be mounted via a selected one of the mounting holes 3120 to ensure that the two ends thereof can be balanced on the plank support.

Figure 8:
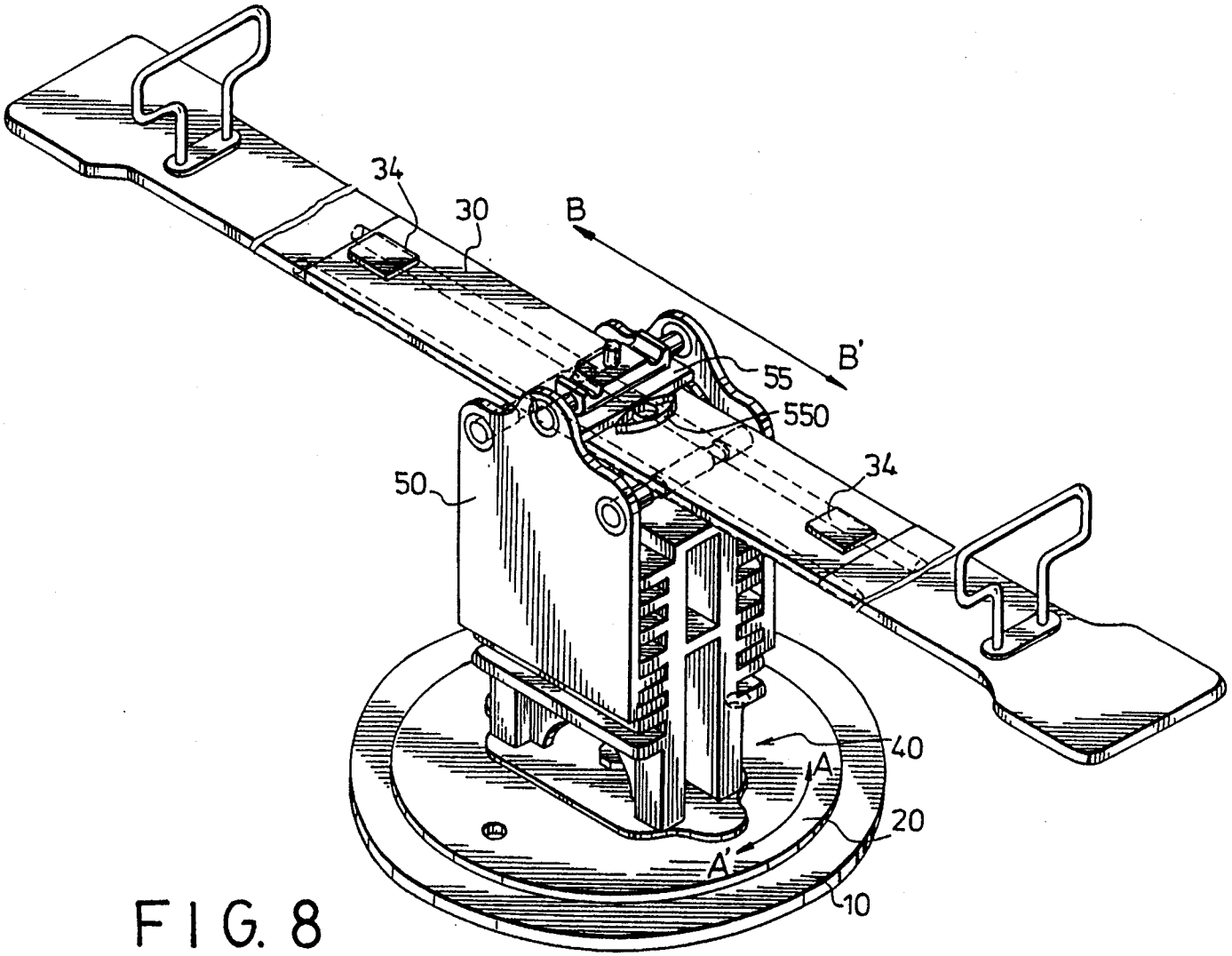
FIG. 8 illustrates a fourth playing mode of the game apparatus of the present invention.

FIG. 8 illustrates the preferred embodiment when operable in a fourth playing mode. The arrangement of the preferred embodiment when operating in the fourth mode is substantially similar to that when the preferred embodiment is operating in the second mode. However, the pegs 7 are removed so that, aside from permitting alternating forward and rearward movement of the plank unit 30, as indicated by the line B–B', the plank unit 30 is simultaneously rotatable relative to the base unit 10, as indicated by the line A–A'.

Figure 9:
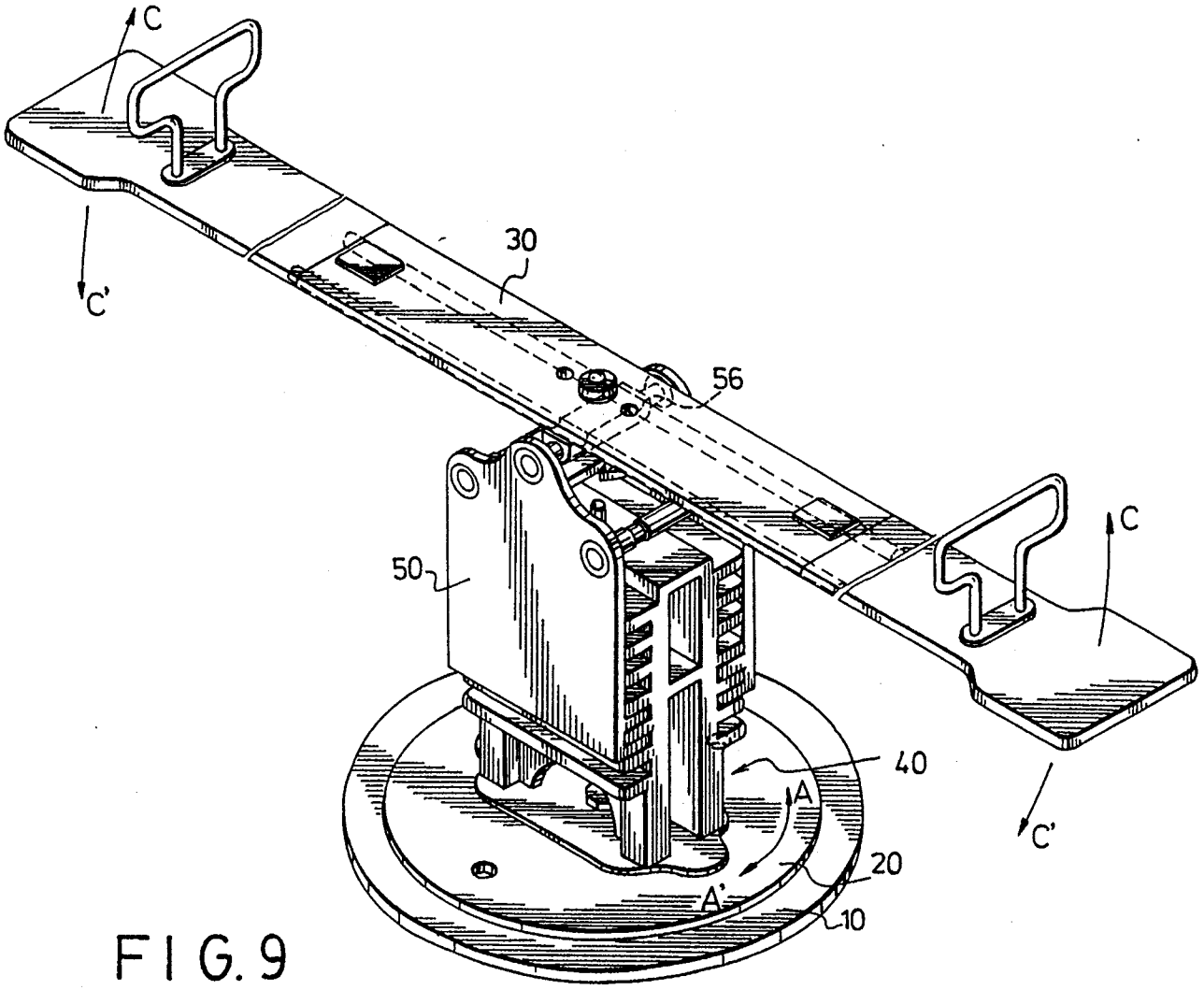
FIG. 9 illustrates a fifth playing mode of the game apparatus of the present invention.

FIG. 9 illustrates the preferred embodiment when operable in a fifth playing mode. The arrangement of the preferred embodiment when operating in the fifth mode is substantially similar to that when the preferred embodiment is operating in the third mode. However, the pegs 7 are removed so that, aside from permitting reciprocating upward and downward pivoting movement of the plank unit 30, as indicated by the line C–C', the plank unit 30 is simultaneously rotatable relative to the base unit 10, as indicated by the line A–A'.

Note that the game apparatus of the present invention, which can be operated in five different playing modes, is relatively simple in construction and requires a relatively small space when in use, thereby making the present invention ideal for use in compact playgrounds. The objective of the present invention is thus achieved.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A game apparatus with multiple playing modes, comprising:

a base unit;

a plank support mounted uprightly on said base unit, said plank support including: a pair of parallel upright plates; a balancing seat extending between top ends of said upright plates and having two ends mounted rotatably on said upright plates; a cylindrical support rod which extends between said upright plates below said balancing seat and which has two ends mounted rotatably on said upright plates; and a positioning beam extending between said upright plates and being spaced vertically from said support rod so as to form a clearance therewith; and an elongated plank unit mounted to said plank support selectively in a first position, wherein said plank unit has an intermediate portion which is mounted removably on said balancing seat to permit reciprocating pivoting movement of said plank unit, and a second position, wherein said plank unit extends movably and removably through said clearance such that said plank unit is supported by said support rod to permit alternating forward and rearward sliding movement of said plank unit relative to said plank support.

2. The game apparatus as claimed in claim 1, wherein said positioning beam is disposed above said support rod, said plank unit having a bottom surface provided with a slide rail that extends along a longitudinal length thereof, said balancing seat being formed with a recess along a transverse length thereof to permit extension of said slide rail therethrough when said plank unit is mounted to said plank support in said first position, said support rod being formed with an annular peripheral groove for supporting said slide rail therein when said plank unit is mounted to said plank support in said second position.

3. The game apparatus as claimed in claim 2, wherein said plank unit has two end portions interconnected by said intermediate portion, said intermediate portion having a top surface provided with a spaced pair of stop members, each of which being adjacent to a respective one of said end portions and being disposed along the longitudinal length of said plank unit, said positioning beam having two sides provided respectively with a spring unit that is compressible by one of said stop members.

4. The game apparatus as claimed in claim 3, further comprising a support plate mounted rotatably on said base unit, said plank support being secured on said support plate.

5. The game apparatus as claimed in claim 4, further comprising locking means for locking selectively and non-rotatably said support plate on said base unit.

6. The game apparatus as claimed in claim 5, wherein said base unit and said support plate are formed with alignable fixing holes, and said locking means comprises a peg insertable selectively and removably into said fixing holes to lock non-rotatably said support plate on said base unit.

7. The game apparatus as claimed in claim 6, wherein said base unit has an annular rotary plate mounted rotatably thereon, said support plate being supported on said rotary plate.

8. The game apparatus as claimed in claim 7, further comprising a plurality of ball bearings interposed between said rotary plate and said base unit to mount rotatably said rotary plate on said base unit.

9. The game apparatus as claimed in claim 6, wherein said plank support comprises an upright first support secured on said support plate and a second support, said first support having opposite sides respectively formed with a plurality of vertically-spaced horizontally-extending ribs, said second support including said upright plates, said balancing seat, said support rod and said positioning beam, each of said upright plates having a bottom end and an inner surface formed with a spaced pair of horizontally-extending engaging ribs adjacent to said bottom end thereof, said engaging ribs cooperating to form a horizontally-extending slot on each of said upright plates, each of said slots engaging removably a selected one of said ribs on said first support.

10. The game apparatus as claimed in claim 3, wherein said end portions of said plank unit are connected detachably to said intermediate portion.

11. The game apparatus as claimed in claim 9, wherein said first support has a top surface, and said elongated plank unit is further mounted to said plank support selectively in a third position, during which said second support is removed from said first support and said intermediate portion of said plank unit is mounted removably on said top surface of said first support.

12. The game apparatus as claimed in claim 11, wherein said intermediate portion of said plank unit has a central section which is formed with at least one mounting hole along the longitudinal length of said plank unit, said balancing seat of said second support being formed with an upwardly projecting stub which engages a selected said mounting hole in said intermediate portion of said plank unit when said plank unit is mounted to said plank support in said first position, said top surface of said first support being formed with an upwardly projecting stub which engages a selected said mounting hole in said intermediate portion when said plank unit is mounted to said plank support in said third position.

13. The game apparatus as claimed in claim 12, further comprising a locking nut-and-spring washer unit which engages said stub of said balancing seat to mount removably said plank unit in said first position, and which engages stub of said first support to mount removably said plank unit in said third position.

* * * * *